United States Patent [19]

Reavis, Jr.

[11] 4,046,446

[45] Sept. 6, 1977

[54] ELECTRICAL TERMINAL FOR JOINING TWO WIRES

[75] Inventor: Robert Philmore Reavis, Jr., Statesville, N.C.

[73] Assignee: AMP Incorporated, Harrisburg, Pa.

[21] Appl. No.: 685,963

[22] Filed: May 13, 1976

[51] Int. Cl.[2] ..... H01R 13/38

[52] U.S. Cl. ..... 339/99 R

[58] Field of Search ..... 339/97-99

[56] References Cited

U.S. PATENT DOCUMENTS

| | | | |
|---|---|---|---|
| 3,377,611 | 4/1968 | Pawl | 339/97 P |
| 3,845,455 | 10/1974 | Shoemaker | 339/97 R |
| 3,854,114 | 12/1974 | Kloth et al. | 339/97 R |
| 3,860,318 | 1/1975 | Reavis, Jr. et al. | 339/99 R |

*Primary Examiner*—Joseph H. McGlynn

*Attorney, Agent, or Firm*—Robert W. Pitts; William J. Keating; Frederick W. Raring

[57] ABSTRACT

A terminal for use in establishing electrical contact with a plurality of wires is disclosed. A slotted terminal which can accept two wires, one above the other, in the same slot may be used in a multi-contact connector or as a splicing connector. Spaced apart plate sections containing an aligned pair of slots are employed. Offset contact slot sections and strain relief slot sections are used to ensure independent contact.

10 Claims, 8 Drawing Figures

ELECTRICAL TERMINAL FOR JOINING TWO WIRES

BACKGROUND OF THE INVENTION

1. Field of the Invention

This invention relates to the solderless interconnection of electrical wires. More specifically, this invention relates to the use of slotted resilient terminal members which pierce the surrounding insulation and establish intimate mechanical and electrical contact with the underlying conductor core. This invention also relates to the establishment of electrical contact with two wires in one slot.

2. Prior Art

The use of resilient slotted electrical terminals to form a solderless electrical connector is illustrated in U.S. Pat. Nos. 3,012,219 and 3,617,983. Each of these patents disclose a metallic contact terminal having two parallel legs and a pair of aligned slots. With these devices, a redundant connection may be established with one wire in both slots. Similar terminals have been incorporated in multi-contact electrical connectors such as that disclosed and claimed in U.S. Pat. No. 3,760,335. None of these devices have dealt specifically with establishing electrical contact with two wires in the same slot or in the same pair of slots.

Contact terminals capable of establishing independent contact with two wires in the same slot are disclosed in U.S. Pat. Nos. 3,860,318, 3,877,773 and 3,950,062. Each of these devices employ a transverse shear or slot to form semi-independent spring systems. In this manner, contact is established with each wire by a semi-independent spring system.

U.S. Pat. No. 3,183,472 discloses a slotted terminal having multiple wires located in a single uniform slot. Such a configuration has, in practice, proved unacceptable. The presence of one wire in a slot generally induces stresses which degrade the contact established with a second wire in the same slot.

SUMMARY OF THE INVENTION

This invention employs a folded terminal member formed of resilient electrically conductive metal. In the preferred embodiment, this folded terminal member comprises a U-shaped member with two parallel legs. A pair of aligned slots, one in each leg, is employed. To terminate a wire, it is positioned with its local axis extending through both slots.

The slots in the legs are not symmetrical. Each slot has a narrow contact slot section and a relatively wider strain relief slot section. These two sections are offset so that the contact slot portion in the one leg is near the top of the slot. In the other leg, the contact slot section is located adjacent the bottom of the slot.

The primary object of this invention is to provide a terminal for use with two wires in the same slot. This objective gives rise to a requirement for isolation of the stresses which develop contact forces with each wire. An objective of this invention, therefore, is the provision of a slot in which the bottom wire will not deform the slot, resulting in an inadequate termination of the top wire, and vice versa. A further object of this invention is to provide a terminal which can be used with one or two wires in the same slot. It is desirable that this terminal be capable of establishing contact with two wires of the same size. It is also desirable that this terminal be capable of establishing a resilient contact with each wire. A significant objective of this invention is a requirement for a gas tight contact with each wire which will not degrade with time.

Figure 1:
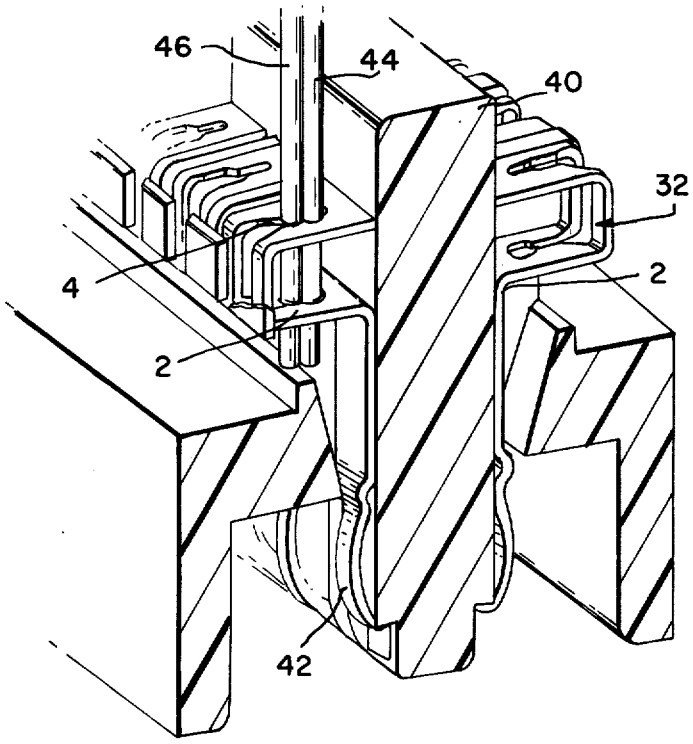
FIG. 1 is a half section showing a multi-contact connector with two wires terminated by one terminal.

DETAILED DESCRIPTION OF THE INVENTION:

FIG. 1 shows a multi-contact connector having two rows of terminals 2 mounted on a connector housing 40. This schematic view is intended to represent a standard electrical connector of the type disclosed and claimed in U.S. Pat. No. 3,760,335. Two wires 44 and 46 have been inserted into the slots 4 of one terminal 2. It is often desirable when using a connector of this type to form an electrical connection having two wires in the same slot. Obviously, this increases the number of wires which can be terminated in a given connector, assuming certain wires need to be commoned. As will be disclosed subsequently, convenient slotted terminals are not capable of establishing an acceptable contact with two wires inserted into one slot as shown. The terminal 2 shown here differs from a conventional terminal shown in U.S. Pat. No. 3,760,335. The slot geometry is unlike that used in conventional connectors.

Figure 2:
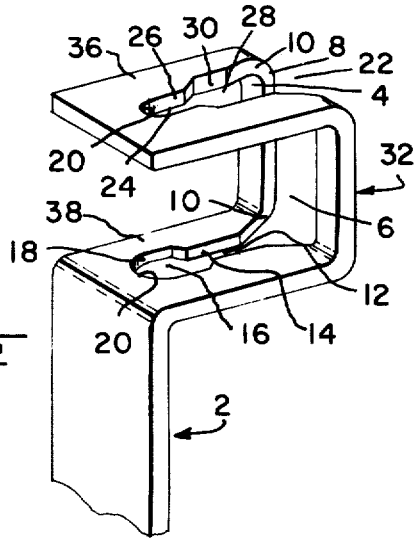
FIG. 2 is an enlarged perspective view of the wire receiving portion of the preferred embodiment of this terminal.

FIG. 2 is an enlarged perspective view of the wire receiving end 32 of a single terminal 2. Wire-receiving end 32 is a U-shaped configuration having first and second generally parallel spaced apart legs 36 and 38. Legs 36 and 38 are joined by bight section 6. A single continuous slot 4 extends through bight section 6 and into each leg 36 and 38. This slot has a relatively wide slot entrance portion 8. Entrance portion 8 extends throughout the length of bight section 6 and continues into both legs 36 and 38. Converging entrance edges 10 extend along the open end 22 of slot 4 in each leg 36 and 38. Slot 4 has two dead ends 20 each located intermediate the ends of one leg. The geometry of slot 4 between open end 22 and dead end 20 in leg 36 differs from the corresponding geometry in leg 38. In leg 36, a contact slot section 24 is located adjacent to dead end 20. This contact slot section is defined by oppositely facing edges 26. Between contact slot section 24 and open end 22, in leg 36, lies strain relief slot section 28. Strain relief slot section 28 is defined by oppositely facing edges 30. The width of contact slot section 24 is relatively narrower than the width of strain relief slot section 28. The length of sections 24 and 28 is, however, schematically equivalent in the preferred embodiment of this invention.

Leg 38 has a contact slot portion 12 adjacent the open end of the slot and a strain relief slot section 16 adjacent the inner dead end 20. In the preferred embodiment of this invention, the width of the contact slot sections in each leg is generally equal. The two strain relief slot sections also have the same width. The edges defining the pertinent slot sections are generally parallel to each other. It is not essential that the edges be perfectly parallel, however. The edges of the contact and strain relief sections are, however, parallel when compared to the converging entrance edges 10. The precise geometry of the slot will be dependent upon the thickness of the terminal, upon the size of the wire, and upon the length of the slot and terminal edges. In certain cases, it may be desirable to employ slightly divergent contact slot edges.

Figure 3:
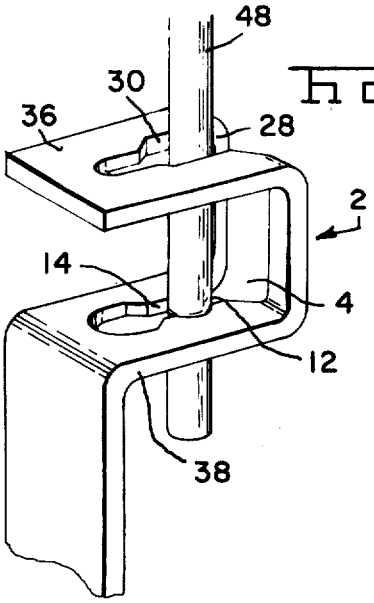
FIG. 3 shows a single wire positioned near the top of the slot.

FIG. 3 shows a single wire 48 inserted into the outer portion of slot 4 in terminal 2. This wire is gripped by the edges of contact slot portion 12 in leg 38 and the edges of strain relief section 28 in leg 36. Edges 14 in leg 38 penetrate the insulation of wire 48 and establish contact with the underlying conductive core. Edges 30 in leg 36 also penetrate the insulation of wire 48. Since the width of slot 28 is greater than that of slot 12, edges 30 do not penetrate wire 48 as deep as edges 14. Edges 30 provide a strain relief for wire 48. Depending on the precise dimensions, edges 30 may also establish a redundant contact with the wire 48.

Figure 4:
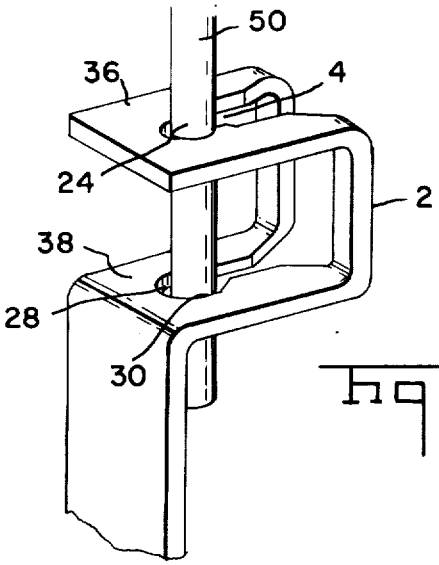
FIG. 4 is a similar view showing the wire positioned near the bottom of the slot.

FIG. 4 shows a wire 50 located adjacent the bottom of slot 4 in terminal 2. Here the primary electrical contact is established by contact section 24 in leg 36. Wire 50 extends through strain relief section 28 and wire 38. Since the width of the strain relief section 28 is greater than the width of a corresponding contact slot, stresses developed in the leg 38 would be less than the stresses developed in leg 36.

Figure 5:
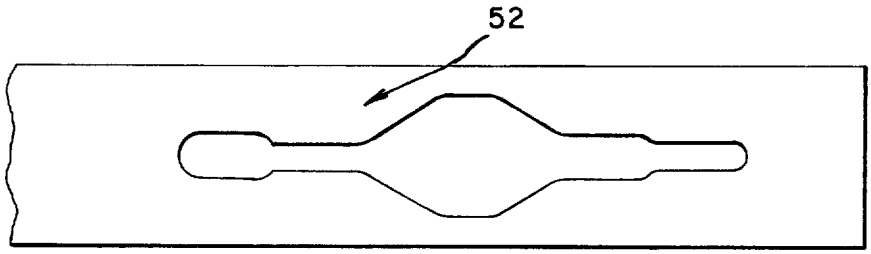
FIG. 5 is a blank illustrating the appropriate slot geometry.

FIG. 5 shows a blank used to form terminal 2. The geometry of slot 4 should be readily apparent from this view.

Figure 6:
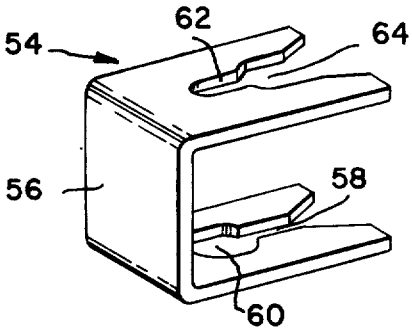
FIG. 6 is a view showing an alternate embodiment of this invention.

FIG. 6 is an alternate embodiment of this invention. Terminal 54 has two parallel legs with an intermediate section 56. Each leg has a slot extending inwardly from its free end. The position of contact slot 58 and strain relief slot 60 is reversed from that of opposite contact slot 62 and strain relief slot 64.

Figure 7:
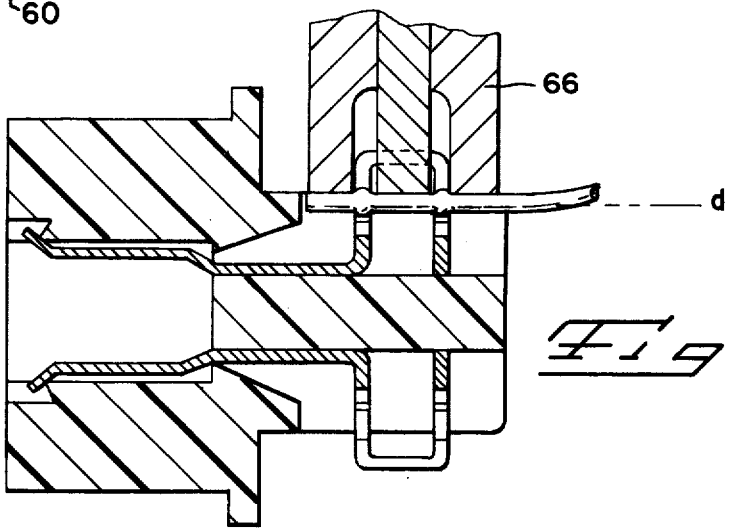
FIG. 7 is a schematic view showing the insertion of one wire into the top portion of a slotted terminal located in a connector.
Figure 8:
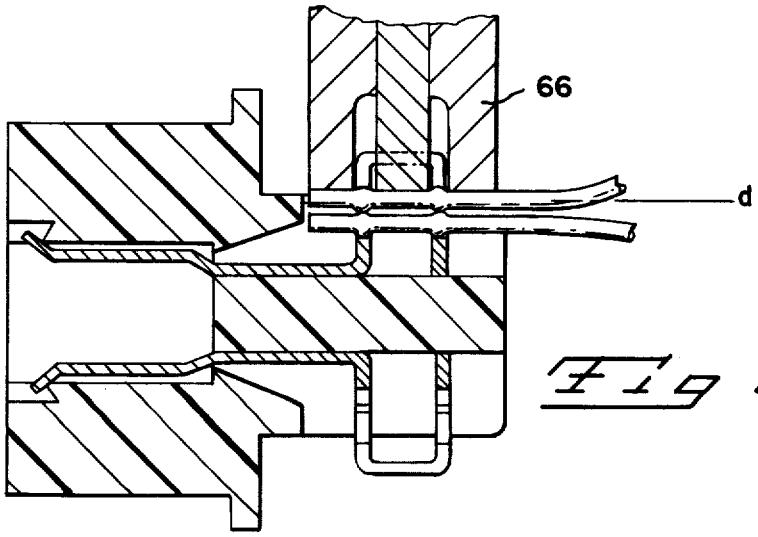
FIG. 8 is a similar view showing the insertion of a second wire on top of a wire located in the same slot.

As with conventional slotted terminals, wires are inserted laterally of their axis and the slots by a stuffer as illustrated by 66. U.S. Pat. No. 3,766,622 discloses a semi-automatic insertion apparatus which could be used in conjunction with this terminal. Generally, a stuffer 66 would travel along an insertion path having a fixed length. Depth of insertion for a typical wire into a convenient slotted terminal would be essentially constant. Terminal 2 embodying the instant invention has a slot 4 with varying dimensions. A wire would normally be located either adjacent the bottom of the slot or adjacent the top of the slot in contact with the appropriate contact slot section. At first glance, this would seem to require a tool capable of inserting a wire at two different depths. FIGS. 6 and 7 illustrate an insertion technique which employs a stuffer inserting a wire to a given depth d as shown in FIG. 7. When a second wire is inserted above the first as shown in FIG. 8, it too is inserted to the depth *d.* The bottom wire is then driven further into the slot until it occupies the position shown in FIG. 8 and in FIG. 4. Note that the primary electrical contact for each wire is formed simultaneously during the insertion step shown in FIG. 8.

The principal reason necessitating the unique slot geometry to terminate two wires in one slot is the interaction between each wire and the resilient terminal when a wire is inserted into a slot. When a wire is inserted into a slot, both the wire and the slot undergo elastic and/or plastic deformation. Stresses are developed in the terminal and these stresses generate the necessary normal contact force to ensure a good electrical connection. A second wire may be inserted into the same slot but the slot geometry has been deformed because of the presence of the first wire. This alone could account for an unacceptable contact with the second wire since the required minimum contact force might not be generated. A second pnenomenon might also occur. As the second wire is inserted into the slot further elastic deformation could occur in the terminal resulting in a loosening of the original contact with the first wire. Some metal-to-metal contact between the first wire and the terminal could be lost. Oxidation of the bare wire metal surface and the bare edges of the terminal could then occur, resulting in degradation of the electrical contact. The slot geometry employed in this invention minimizes this tendency. With this invention, the principal stresses in each terminal leg are generated by the presence of a wire in the slot contact section. Stresses developed by a wire in the strain relief section are minimal in comparison.

The dimensional relationship employed in the slot used in a preferred embodiment of this invention can be used with other resilient solderless terminals employing a redundant contact. For example, the contacts shown in U.S. Pat. Nos. 3,867,005 and 3,926,498 might be modified in accordance with the teaching of this invention to employ offset contact slot and strain relief slot sections. Such an application of this invention to a somewhat different geometry retains the principal of this invention in spite of the somewhat different structure and is an illustration of the breadth of this invention.

I claim:

1. An electrical terminal for establishing a resilient electrical contact with two locally parallel and adjacent wires, said terminal comprising:

first and second spaced-apart slots, each slot being defined by adjacent linear surfaces on an integral metallic terminal member, a relatively narrow contact slot section adjacent the top in said first slot and a similar contact slot section adjacent the bottom of said second slot, and a relatively wider slot section adjacent the bottom of said first slot and a similar relatively wider slot section adjacent the top of said second slot, whereby positioning said two wires, one above the other, in both slots results in the primary electrical contact with said top wire being formed by said first slot and the primary electrical contact with said bottom wire being formed by said second slot.

2. An electrical terminal as set forth in claim 1 wherein said terminal member comprises a folded plate-like member having first and second legs, with one slot cut in each of said legs.

3. An electrical terminal as set forth in claim 1 wherein said edges are generally parallel in said contact slot portion of each slot.

4. An electrical terminal comprising:

a folded terminal member of resilient electrically conductive metal having first and second legs, a slot in each of said legs, said slot extending inwardly from an open end on one edge of each of said legs to an inner dead end intermediate the ends of each leg, a first narrow section in each of said slots formed by oppositely facing generally parallel edges of said slot, a second relatively wider section in each of said slots formed by oppositely facing generally parallel edges of said slot, said narrow section in said slot in said first leg being adjacent to said inner dead end and said wider section being adjacent to said open end, and said narrow section in said slot in said second leg being adjacent to said open end and said wider section being adjacent to said inner dead end, whereby two side-by-side wires may be inserted into both slots, one above the other, electrical contact being established between the bottom wire and said narrow section of said slot in said first leg and said electrical contact being established between the top wire and said narrow section of said slot in said second leg.

5. A terminal as set forth in claim 4 wherein said first leg is generally parallel to said second leg.

6. A terminal as set forth in claim 4 wherein said first and second legs are joined by a bight portion, said slots in said first and second leg being joined by a slot in said bight portion to form one continuous slot having a varying width.

7. A terminal as set forth in claim 4 wherein the width of said narrow sections in each slot is substantially equal.

8. A terminal as set forth in claim 7 wherein the width of said relatively wider sections in each slot is substantially equal.

9. The combination of two wires and an electrical terminal, each wire in mechanical and electrical contact with said terminal, said combination comprising a terminal comprising a folded electrically conductive metallic member having two generally plate-like sections, first and second aligned slots, one in each plate-like section, each slot having a contact slot section and relatively wider strain relief slot section, a bottom wire extending through the contact slot section of said first slot and the strain relief section of said second slot, and a top wire extending immediately above said bottom wire extending through the contact slot section of said second slot and through the strain relief slot section of said first slot, whereby the mechanical stresses developed in each of said plate-like sections resulting from the presence of a wire in the relatively narrower contact slot section are relatively unaffected by the stresses developed by the presence of a wire in the relatively broader strain relief section.

10. A method of establishing a mechanical and electricalcontact between two wires in the same pair of aligned slots, one slot having an upper relatively narrower contact slot section and a lower relatively broader strain relief slot section, the other slot having an upper relatively broader strain relief slot section and a lower relatively narrower contact slot section, said method comprising the steps of:

first, inserting a first wire into said upper contact slot section and said upper strain relief slot section, and next inserting a second wire into said upper contact slot section and upper strain relief slot section, said second wire forcing said first wire into said lower contact slot section and said lower strain relief slot section, said first wire entering said lower contact slot section simultaneously with the entrance of said second wire into said upper contact slot section.

* * * * *